United States Patent [19]

Rich

[11] Patent Number: 5,035,072

[45] Date of Patent: Jul. 30, 1991

[54] COLLAPSIBLE RIDING COMPANION

[76] Inventor: Rayma E. Rich, P.O. Box 11349, Las Vegas, Nev. 89111

[21] Appl. No.: 290,683

[22] Filed: Dec. 27, 1988

[51] Int. Cl.[5] ..... G09F 19/00

[52] U.S. Cl. ..... 40/539; 272/8 R; 40/538; 132/54

[58] Field of Search ..... 446/74, 72, 73, 487, 446/268, 75; 272/8 R, 8 N; 40/538, 539; 132/54-56

[56] References Cited

U.S. PATENT DOCUMENTS

| | | | |
|---|---|---|---|
| 1,210,892 | 1/1917 | Borchmann | 446/74 X |
| 3,867,971 | 2/1975 | Hazan | 446/74 X |
| 4,581,904 | 4/1986 | Lehmann et al. | 446/487 X |
| 4,820,231 | 4/1989 | Mikitka et al. | 446/75 X |

*Primary Examiner*—Mickey Yu

[57] ABSTRACT

The present invention provides a collapsible riding companion as a criminal deterrent. In one embodied form, the riding companion includes a simulated human head and torso which sits against a seatback. The simulated head and torso is maintained upright against the seatback by draping a connected piece of fabric, which has a series of horizontal metal bar weights sewn into it, over the seatback. The torso may then be covered with a t-shirt or a zippered, collared shirt. In another embodied form, the simulated human head is retracted into the torso section and the fabric with the horizontal metal bars is removed from the seatback to cover the top of the torso. In this form, the riding companion becomes a lightweight, easy-to-carry rectangular case for travelling.

3 Claims, 3 Drawing Sheets

COLLAPSIBLE RIDING COMPANION

I. BACKGROUND OF THE INVENTION

1. Field of the Invention

The subject invention relates to collapsible riding companions, particularly those which collapse into a case which can be easily carried. In one embodied form, the invention is a rectangular carrying case for travelling, and in another embodied form, it is a simulated human head and torso which sits against a seatback giving the appearance that there is another person present.

2. Description of the Prior Art

One of the most serious problems in society, at this time, is violent crimes, especially those against women. For instance, there has been a 50.2% increase in the number of forcible rapes in the United States between the years 1975–1984, which includes a 6.7% increase between 1983–1984 alone.

As women have increasingly become an integral part of today's work force, more and more women are taking business trips to America's urban centers. Since these businesswomen frequently find themselves in unfamiliar surroundings, and in view of the large number of violent crimes against women, any form of criminal deterrence is a welcome comfort to the travelling businesswoman.

Figures, simulating the human body, have long been used in the prior art for display and/or as childrens' toys. For instance, U.S. Pat. No. 1,525,746 relates to a mannequin with mechanically produced movement. Dolls with heads movable against gravity have been invented, U.S. Pat. No. 4,411,096 and design patents have been issued for inflatable display forms of parts of the human figure, U.S. Pat. No. Des. 256,254, U.S. Pat. No. Des. 256,255, U.S. Pat. No. Des. 256,256 and U.S. Pat. No. Des. 256,257.

Simulated human figures which, in certain configurations, may be hidden from view are also popular as childrens' toys in the prior art. For instance, dolls have been invented whose bodies may be reconfigured into another form, such as an automobile, and vice versa, U.S. Pat. No. 4,580,993, whose extremities are accommodable within a trunk, U.S. Pat. No. 4,411,097, whose extremities are movable to a hidden position within a toy jewelry item, U.S. Pat. No. 4,581,904, and whose heads can be compressed or projected into or from its rubber base, U.S. Pat. No. 1,196,649.

Also found in the prior art are containers which are used on seats. U.S. Pat. No. 3,876,247 relates to a briefcase which, when closed and rested against the back of a seat, can be used as a backrest. U.S. Pat. No. Des. 247,327 relates to an organizer file and storage unit which hangs from the back of an automobile's seat.

Accordingly, those skilled in the art have recognized the need for a criminal deterrent in the form of a simulated human head and torso which can sit in the passenger seat of a car and can also be retracted into a lightweight easy-to-carry case for travelling. The present invention fulfills these needs.

II. SUMMARY OF THE INVENTION

According to the invention, a simulated human head and torso, which can be attached to a vehicle's passenger seat, is retractable into a carrying case for travelling. The case is rectangular in shape with a top which curves along its length. The curved top is covered with a fabric cover which is permanently attached to the back side wall along its length at the line where the curved top meets the back side wall. The other end of the fabric cover can be attached to the front side wall of the case by a snap or velcro at the end of the fabric cover. A handle, used for carrying, is sewn to the fabric cover at the point which is at the top of the curved portion when the fabric cover is attached to the front side wall. Between this handle and the snap at the end of the fabric cover, also sewn into the fabric, are horizontal metal bars which will conform to the shape of the curve of the case when the fabric cover is attached to the front side wall.

Beneath the fabric cover is the means for connecting the simulated human head to the case. A circular protrusion juts out of the top of the case at an angle towards the front of the case. The front side wall of the case is movable and can be unsnapped from the top of the case and turned down at its hinge at the bottom of the case. The top of the front side wall cuts a semicircle out of the case which is wide enough to allow the head to be turned up from inside the hollow case on top of the circular protrusion. The top of the semicircle of the front side wall is tangent to the circular protrusion.

Stored inside the hollow case is a simulated human head which is upside down and faces the rear of the case. The simulated human head is made of hard, solid foam and can be fixed up with any wig, facial hair, makeup and/or accessories as desired. The simulated human head is connected to the case by a hinge at the front of the neck of the simulated human head. The other end of the hinge is attached to the front side of the circular protrusion. At the rear of the neck of the simulated human head is either velcro or a snap, the means of attaching the simulated human head to the circular protrusion. The other half of the velcro or snap is attached to the circular protrusion opposite from the hinge.

To convert the carrying case into the simulated human head and torso sitting in the passenger seat of an automobile, the user must first unsnap the fabric from the front side wall. The fabric, with the horizontal metal bars, is then draped over the top of the passenger seat so that the case sits upright against the seatback with the horizontal metal bars hanging over the seat acting as weights to hold the case upright. The front side wall of the case is then opened and lowered far enough to allow the simulated human head to be turned up from the case, with the use of the hinge, onto the top of the circular protrusion. The front side wall of the case is then closed and snapped shut. The snap or velcro on the back of the neck and circular protrusion are then fastened. Thus, the case itself forms the torso with the top curved to form the shoulders of the torso. The case can be covered by a T-shirt or a zippered, collared shirt which can be stored in the case. The simulated human head and torso can be reconverted into a carrying case by simply reversing the above steps.

It is an object of this invention to provide a companion which simulates the appearance of a human head and torso in the passenger seat of an automobile.

It is another object of this invention to provide a simulated human head and torso which can be hidden from view and contained in a lightweight, easy-to-carry rectangular case.

It is another object of this invention to provide a companion which can be strapped to or hung with weights which are connected to the riding companion from the passenger seat of an automobile.

It is another object of this invention to provide a driver driving alone with the appearance that there is a companion in the passenger seat as a means for deterring potential attackers.

Additional objects and features of the invention will be apparent from the following description in which reference is made to the accompanying drawings.

IN THE DRAWINGS

DETAILED DESCRIPTION OF THE INVENTION

This invention provides a simulated human head and torso which can sit in the passenger seat of a car and can be retracted into a rectangular case which can be easily carried while travelling.

Figure 1:
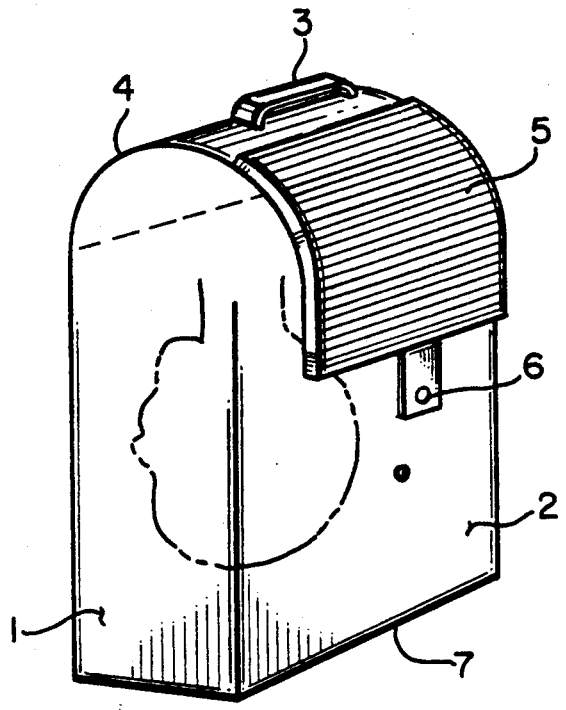
FIG. 1 is a perspective elevational view of a case according to the present invention, the simulated human head being in its retracted condition inside the case and the fabric cover attached to the front side wall, covering the top of the case.

FIG. 1 is the carrying case as it looks with the simulated human head contained inside and the fabric cover attached to the front side wall. The case 1 is vacuformed and is covered with any suitable covering material. The case is rectangular in shape with a top which is curved along the length of the case. The case has a length of approximately 19 inches, a width of approximately 12 inches and a height of approximately 17 to 18 inches to the curved portion of the case and an additional 6 to 7 inches to the top of the case.

The curved portion of the case is covered by fabric 4 which has a carrying handle 3 sewn into the fabric such that the handle lies at the peak of the curved portion of the case when the fabric cover is attached to the front side wall 2. Both ends of the fabric 4 are connected to the case 1 when the case is in its closed position. One end of the fabric 4 is permanently attached to the back side wall of the case 1 along the line 4a where the curved top of the case ends and the back side wall begins. The other end of the fabric is connected at the center of the front side wall 2 of the case 1 by a snap or velcro 6.

Figure 3:
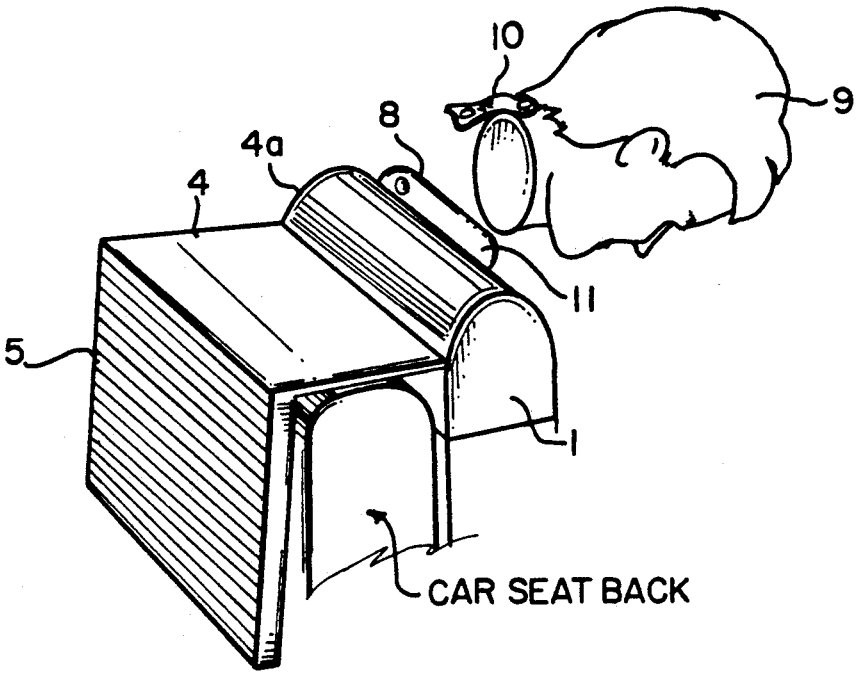
FIG. 3 is a rear perspective of the case with the simulated human head extended from the case and the fabric cover draped over the vehicle's seatback with the horizontal metal bar weights hanging down.

Sewn into the fabric 4 between the handle 3 and the snap 6 are a series of horizontal metal bars 5. The metal bars are of equal length as the fabric and are of such a width that they will conform to the shape of the curved top of the case 1 when the fabric cover is attached to the front side wall 2. They must be of such a weight that when they are draped over an automobile's seat, the case will be supported upright against the seatback as shown in FIG. 3 and FIG. 4.

Figure 2:
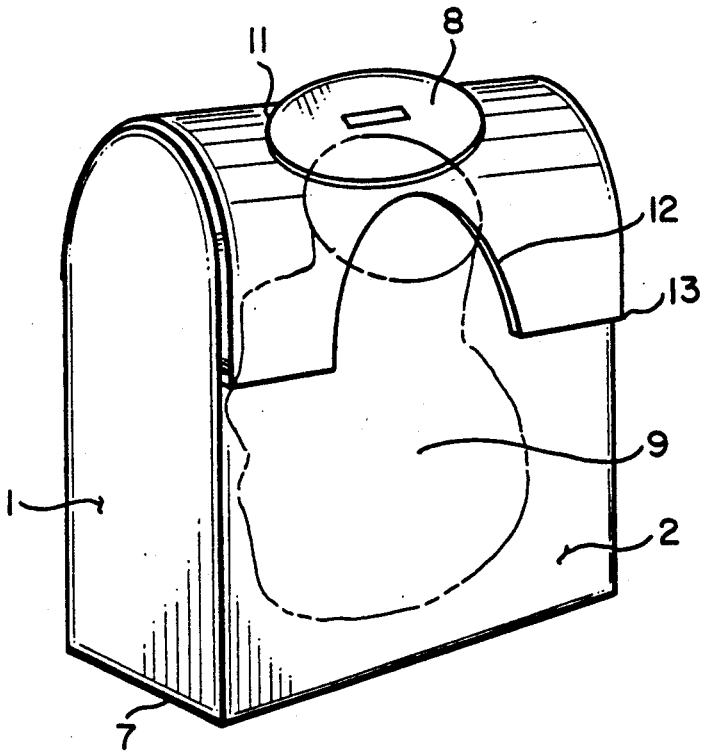
FIG. 2 is a perspective elevational view of the case with the fabric cover removed and the front side wall in its closed position, showing the position of the simulated human head inside the hollow case.

FIG. 2 shows the case 1 with the fabric cover 4 removed. The front side wall 2 of the case 1 may be opened at snaps 13 and turned down at hinge 7 to provide access to the simulated human head 9 inside the hollow case. The top of the front side wall 2 cuts a semicircle 12 from the case 1 tangent to circular protrusion 11 and wide enough to allow the simulated human head 9 to be turned up on hinge 8 on top of the circular protrusion 11. The circular protrusion 11 is of the same diameter as the neck on the simulated human head 9. The circular protrusion juts out no more than one inch from the top of the case and points slightly towards the front of the case 1. The simulated human head 9 when turned up on the hinge 8 to meet the circular protrusion 11 connects at the rear of the circular protrusion by snap or velcro 10 as shown in FIG. 3.

Figure 5:
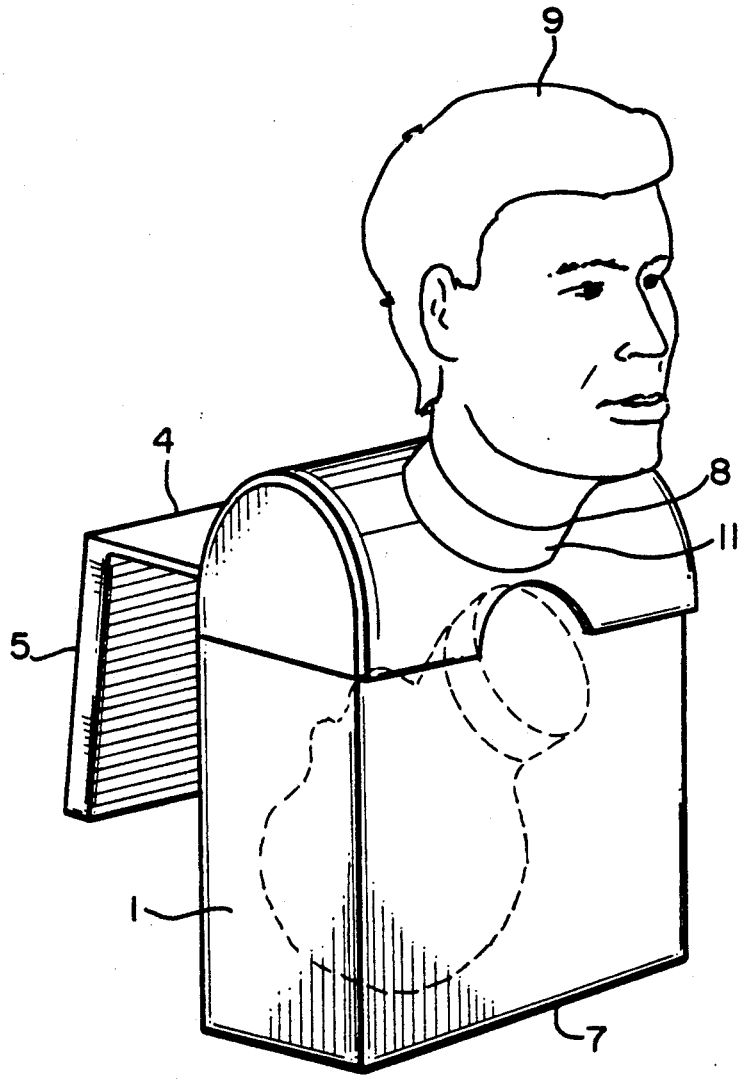
FIG. 5 is a front perspective of the case with the simulated human head extended and attached to the circular protrusion and the fabric cover draped over the vehicle's seat. The front side wall is removed to show the position of the simulated human head when inside the hollow case.

The simulated human head 9 is life size and is made of hard, solid foam. The simulated human head can be fixed with any wig, facial hair, makeup and/or accessories as desired. While being stored inside the case, the simulated human head 9 is upside down and faces the rear of the case 1 as shown in FIGS. 1, 2, and 5.

Figure 4:
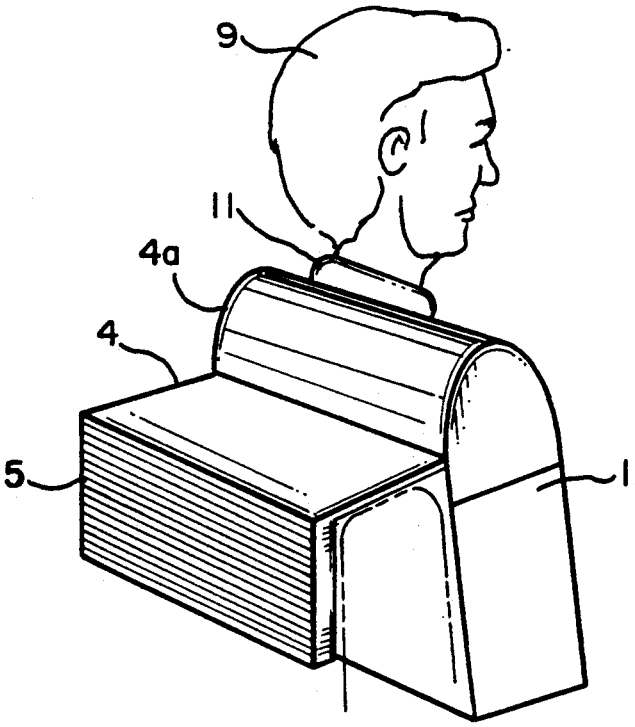
FIG. 4 is a rear perspective of the case with the simulated human head attached on top of the circular protrusion and the fabric cover draped over the vehicle's seatback with the horizontal metal bar weights hanging down.

The rectangular carrying case shown in FIG. 1 is converted to the simulated human head and torso sitting in the passenger seat of an automobile as shown in FIG. 4 as follows: First, snap 6 is unfastened and the fabric cover 4 is draped over the seatback. The horizontal metal bars 5 should rest over the seatback holding the rear of case 1 in place against the seatback. Snaps 13 are then unfastened and front side wall 2 is turned down along hinge 7. Next, simulated human head 9 is turned up along hinge 8 through semicircle 12 until it rests on top of the circular protrusion 11; snap 10 is then fastened. The case 1 and circular protrusion 11 and neck of the simulated human head 9 can be covered by either a T-shirt or a zippered, collared shirt which can be stored in case 1. By simply reversing the above steps, the simulated human head and torso can be reconverted into the carrying case 1 as shown in FIG. 1.

It should be understood by those skilled in the art that various modifications can be made in the present invention without departing from the spirit and scope thereof, as described in the specifications and defined in the appended claims.

I claim:

1. A collapsible riding companion for use as a criminal deterrent comprising, in combination:

a) simulated human head member;

b) a generally rectangular carrying case having the external contour of a human upper torso; said carrying case including plural side walls, a top wall having an outer and inner surface, and a bottom wall to define a hollow interior for storage of said simulated human head member therein, said top wall being hinged to one of said side walls;

c) mounting means for retractably mounting said head member to the outer surface of said top wall in a first extended position and to an inner surface of said top wall in a second retracted position; and d) a fabric cover for enveloping the outside of said carrying case when said head member is in the first extended position which simulates a seated human head and torso.

2. A collapsible riding companion as defined in claim 1 wherein one of said side walls is pivotally hinged to said bottom wall to expose the hollow interior of the case when said case is open.

3. A collapsible riding companion as defined as claim 1 wherein said human head member comprises a toupee composed of artificial hair removably attached to the top surface of said head member.

* * * * *